US005470536A

United States Patent [19]

Järvimäki

[11] Patent Number: 5,470,536

[45] Date of Patent: Nov. 28, 1995

[54] CUVETTE MATRIX

[75] Inventor: Kari Järvimäki, Espoo, Finland

[73] Assignee: Labsystems Oy, Helsinki, Finland

[21] Appl. No.: 140,491

[22] Filed: Oct. 25, 1993

[30] Foreign Application Priority Data

Nov. 11, 1992 [FI] Finland ..... 925117

[51] Int. Cl.[6] ..... B01L 3/00

[52] U.S. Cl. ..... 422/102; 422/99; 422/104; 206/558; 206/562; 206/565; 220/23.4; 220/23.83; 220/23.86

[58] Field of Search ..... 422/99, 102, 104; 206/443, 446, 558, 562, 565; 220/23.4, 23.83, 23.86

[56] References Cited

U.S. PATENT DOCUMENTS

| | | | |
|---|---|---|---|
| 3,853,217 | 12/1974 | Scordato et al. | 206/223 |
| 3,907,505 | 9/1975 | Beall et al. | 422/102 |
| 3,994,594 | 11/1976 | Sandrock et al. | 422/102 X |
| 3,998,594 | 12/1976 | Horne | 422/102 X |
| 4,130,978 | 12/1978 | Cohen | 206/562 X |
| 4,207,289 | 6/1980 | Weiss | 422/102 X |
| 4,263,256 | 4/1981 | Morle | 422/66 |
| 4,357,301 | 11/1982 | Cassaday et al. | 422/102 X |
| 4,599,314 | 7/1986 | Shami | 422/102 X |
| 4,871,674 | 10/1989 | Matsui et al. | 422/102 X |
| 4,933,148 | 6/1990 | Perlman | 422/100 |
| 4,985,207 | 1/1991 | Hayashi | 422/102 |
| 5,080,232 | 1/1992 | Leoncavallo et al. | 206/446 |
| 5,084,246 | 1/1992 | Lyman et al. | 422/102 X |
| 5,096,672 | 3/1992 | Tervamäki et al. | 422/102 |
| 5,098,661 | 3/1992 | Froehlich et al. | 422/102 |
| 5,232,669 | 8/1993 | Pardinas | 422/104 X |

FOREIGN PATENT DOCUMENTS

| | | |
|---|---|---|
| 0100664 | 7/1983 | European Pat. Off. . |
| 0152964 | 2/1985 | European Pat. Off. . |
| 0188009 | 12/1985 | European Pat. Off. . |
| 415307A3 | 3/1991 | European Pat. Off. . |
| 1431477 | 4/1965 | France . |
| 2711853 | 9/1978 | Germany . |
| 4150862 | 5/1992 | Japan . |
| 2064998 | 6/1981 | United Kingdom . |
| 2161398 | 1/1986 | United Kingdom . |
| WO93/00420 | 1/1993 | WIPO . |

*Primary Examiner*—James C. Housel
*Assistant Examiner*—Maureen M. Wallenhorst
*Attorney, Agent, or Firm*—Armstrong, Westerman, Hattori, McLeland & Naughton

[57] ABSTRACT

A cuvette matrix, having a row of attached cuvettes, from which it is possible to detach one cuvette to be placed in an opening in a stand. On the outer surface of each cuvette, at an angle from the longitudinal direction of the row of cuvettes, there is a holder member, which facilitates the cuvette to adhere to the sides of an opening. The holder member is moved into contact with the stand when the cuvette is turned in the opening.

17 Claims, 2 Drawing Sheets

CUVETTE MATRIX

FIELD OF THE INVENTION

The invention relates to laboratory technology and concerns a cuvette matrix which can be used e.g. in diagnostic assay methods.

PRIOR ART

For example, in diagnostic assay methods, sets of cuvettes comprising one or more rows of cuvettes are commonly in use. Standard-sized 8*12 microtitration plates and their partial matrices are especially common.

Also such cuvette sets are used, in which the cuvettes have been detachably joined to each other. In this way, just a required number of cuvettes can be used at a time in each case. Such a cuvette set provided with breakable stems is known for example from the patent application publication FI-A-894025 (corresponds e.g. to the publication U.S. Pat. No. 5,096,672). The cuvette set is connected with a stand which has square holes corresponding to the cuvettes and in each of them resilient holder means for keeping the cuvettes in place.

When single cuvettes detached from the matrix described above are used, a cuvette does not always stay sufficiently satisfactorily stationary in the stand.

BRIEF SUMMARY OF THE INVENTION

The main object of this invention is to provide a cuvette matrix in which a single cuvette removed therefrom stays better than the known cuvettes in position in the stand.

The most essential feature of the invention is the fact that on the outer surface of the cuvette at an angle relative to the longitudinal direction of the cuvette row there is a holder member, which, together with the walls of the cuvette opening of the stand, keeps the cuvette tightly in position after it has been turned in the opening.

The invention and and some preferred embodiments are defined in detail in the patent claims.

The cuvette matrix in accordance with the invention comprises one or more cuvette rows, in which the cuvettes are connected to one another such that when desired, it is possible to detach one or more cuvettes to be used at a time. The cuvette matrix is preferably prepared from some plastic, such as polystyrene suitable for the purpose. For optical measurements, the bottom of the cuvette is made transparent, when so needed. The cuvettes are especially suitable for use in various diagnostic assays to be made with fluid samples. When required, the cuvettes can be pretreated, e.g., by coating with an antigen of an antibody to be determined.

The cuvettes are meant to be placed in a specific stand which has an opening for each cuvette. The cuvettes stay in the opening by means of friction. The opening is preferably a square by shape, but it may also have another shape, such as a hexagon. The stand with its cuvettes can then be brought for measurement e.g. into a vertical measurement photometer.

The cuvette preferably is by its outer surface slightly downwardly tapering, whereby its positioning in the stand is easier. On the outer surface there may also be an extension or like which facilitates the positioning of the cuvette at a certain height relative to the stand.

Each cuvette has on its outer surface a holder member, which, when turning the cuvette, fixes the cuvette even more rigidly to the opening. Preferably the holder member is essentially at an angle of 45° from the longitudinal direction of the row of cuvettes, whereby the cuvette is correspondingly turned essentially by 45°. Preferably there are two holder members on the opposite sides of the cuvette.

Preferably the holder member is an extension on the surface of the cuvette. The extension is best a vertical plane, which, when turning the cuvette, steadily positions against the vertical wall of the opening of the stand. The extension may also be e.g. a nodule or a ridge of some kind, whereby the wall of the opening may have a notch or groove corresponding thereto.

Preferably the opening of the stand further has resilient pressing members, which keep the cuvette in position.

BRIEF DESCRIPTION OF THE DRAWINGS

In the following, an embodiment of the invention is described as an example. In the drawings of the description.

Figure 1:
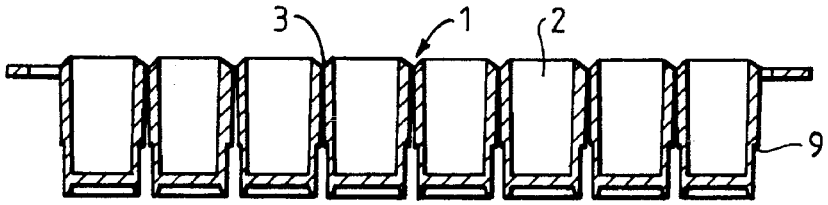
FIG. 1 shows a cuvette matrix seen from the front.
Figure 2:
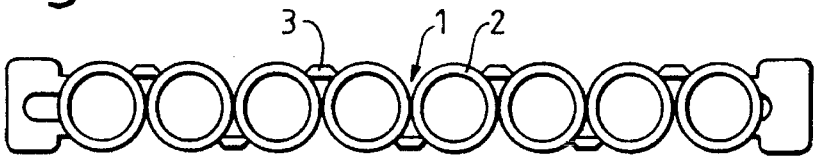
FIG. 2 shows the same matrix seen from above.
Figure 3:
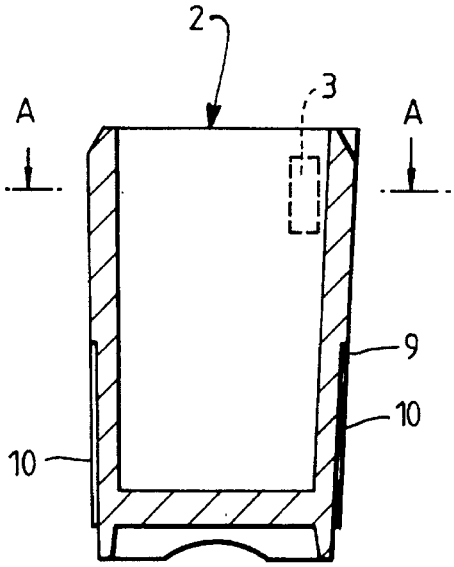
FIG. 3 shows a cuvette matrix seen from the side.
Figure 4:
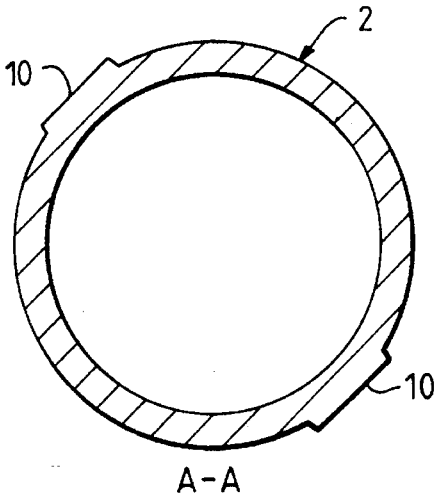
FIG. 4 shows the same cuvette seen from above.
Figure 5:
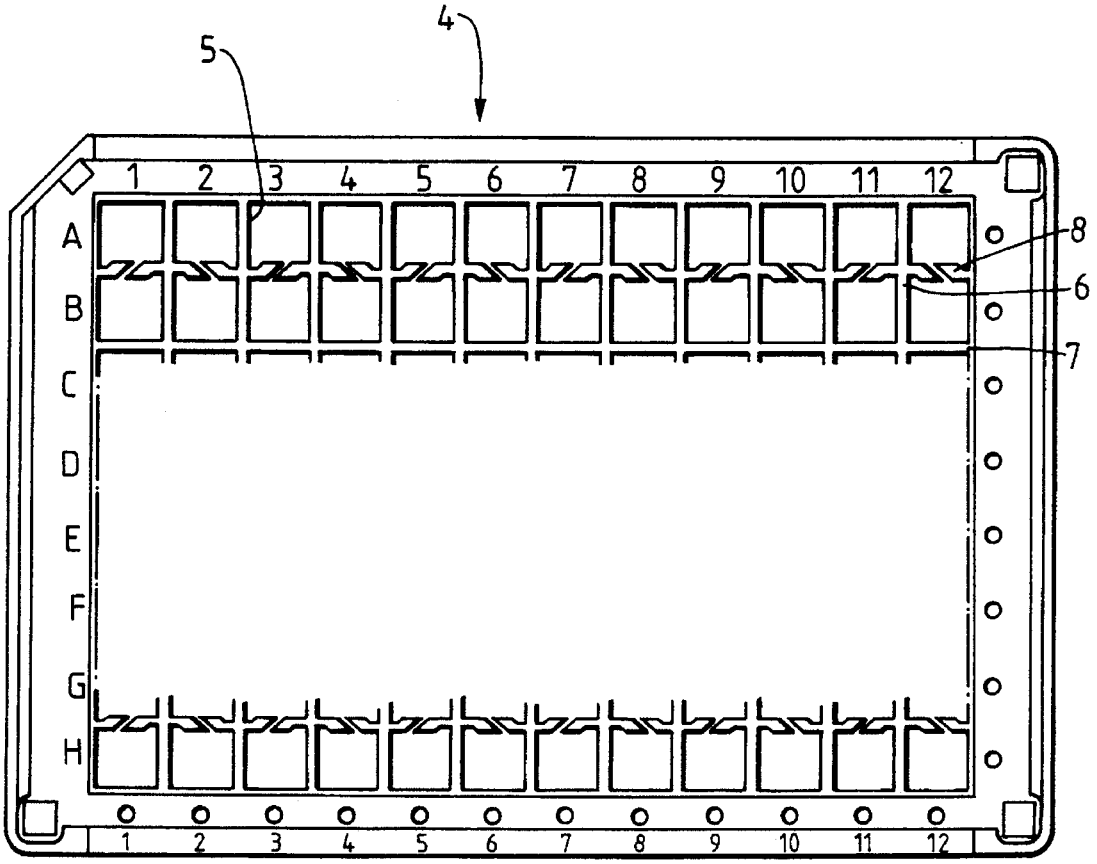
FIG. 5 shows a stand for cuvette matrices seen from above.

The cuvette matrix of the figures, and its stand are by their principal solution similar to those described in the U.S. Pat. No. 5,096,672. Said publication is incorporated as a reference herein.

DETAILED DESCRIPTION OF THE DRAWINGS

In the cuvette matrix 1, the cuvettes 2 are connected to each other such that a desired number of cuvettes can be detached from the matrix by folding the stem 3 between the cuvettes. The cuvettes are circular by their cross-section and slightly narrower by their lower part. The entire matrix or a part thereof can be placed in a stand 4, which has 8×12 holes 5 with square cross-section. The side of the hole is slightly broader than the diameter of the bottom of the cuvette. The cuvettes can thus be positioned into the holes of the stand. However, the side of the hole is slightly narrower than the cuvette diameter above the bottom. The cuvette thus adheres to the hole by means of friction.

For facilitating folding, the stem 3 has been narrowed. In the solution of the figure, there is a narrowing at each end, but also e.g. one narrowing may be made in the center, whereby the stem always breaks symmetrically.

The holes 5 form eight horizontal rows marked with letters (A–H) and twelve vertical columns marked with numerals (1–12). The holes are bounded by a rectangular frame and its intermediate walls. The intermediate walls 6 parallel with the vertical columns are stiff and continuous. Also, every second intermediate wall 7 of the horizontal rows is continuous and stiff.

Starting from the first intermediate wall 7 from the edge, parallel with the horizontal rows, every second intermediate wall parallel with the rows has been broken at the central line of the vertical column vertically, but obliquely relative to the intermediate wall and such that a small gap is formed between the broken ends. The fingers 8 thus formed parallel with the intermediate walls slightly bend on a horizontal plane. The intermediate walls are at the fingers slightly thicker.

One corner of the stand 4 is chamfered, which facilitates the identification of the correct position of the stand e.g. automatically in analyzer devices.

The upper surface of the intermediate walls 6 and 7 and an extension on the inner edge of the frame abut on a shoulder 9 on the outer surface of the cuvette. In this way, the cuvettes always position at the same height on the stand.

In each cuvette 2, there is at an angle of 45° from the longitudinal direction of the cuvette row on opposite sides beneath the shoulder 9 a vertical planar extension 10. When a row formed by two or more cuvettes is placed in the stand, 4, the extentions position on the corners of the holes 5. A continuous cuvette row always stays well in position due to a friction caused by a potential warpage, and to the so-called "desk-drawer effect". When a single separate cuvette is used, it is turned in the hole of the stand such that the extensions position against the walls of the hole. In this case, the fingers 8 press the cuvette harder and the cuvette stays well stationary.

I claim:

1. A cuvette matrix, comprising:

a plurality of cuvettes capable of being placed within a stand both when connected together and individually;

connections formed between adjacent cuvettes which interconnect said plurality of cuvettes together in at least one row;

said at least one row extending along a longitudinal axis connecting centers of said cuvettes;

each of said cuvettes in said at least one row of cuvettes having a width, said width extending along an axis generally perpendicular to said longitudinal axis and through a center of said cuvette, each said cuvette having a first outermost point along said perpendicular axis and a second outermost point along said perpendicular axis at opposite sides of said width;

said connections being disconnectable such that it is possible to detach one cuvette from said at least one row so as to be placed in a stand having an opening for the cuvette;

at least one holder member on the outer surface of each cuvette;

said at least one holder member being located at an angle offset from the longitudinal axis of the at least one row of cuvettes and being located substantially between said longitudinal axis and either of said first and second outermost points of said widths of the cuvettes;

said at least one holder member on the outer surface of each cuvette being at a location such that (1) when said at least one row of cuvettes is still interconnected, said at least one holder member of each cuvette is at said angle from the longitudinal axis and is capable of being placed within a respective hole in a stand with said at least one holder member being away from a fixing position against a wall of the stand and such that (2) when one of said cuvettes of said at least one row of cuvettes is detached and placed within an opening in the stand with said at least one holder member also within the opening, said one cuvette is capable of being rotated to the fixing position within the stand.

2. A cuvette matrix according to claim 1, wherein the at least one holder member is at an angle of approximately 45° from the longitudinal axis of the at least one row of cuvettes.

3. A cuvette matrix according to claim 1, wherein the at least one holder member is an extension extending from the outer surface of each cuvette.

4. A cuvette matrix according to claim 3, wherein the extension has an outer surface which is a plane.

5. A cuvette matrix according to claim 1, wherein there are two holder members which are positioned on opposite sides of each cuvette.

6. In combination:

(1) a stand having an array of holes for supporting cuvettes; and (2) a cuvette matrix, comprising:

a plurality of cuvettes capable of being placed within said stand both when connected together and individually;

connections formed between adjacent cuvettes which interconnect said plurality of cuvettes together in at least one row;

said at least one row extending along a longitudinal axis connecting centers of said cuvettes;

each of said cuvettes in said at least one row of cuvettes having a width, said width extending along an axis which is generally perpendicular to said longitudinal axis and through a center of said cuvette, said cuvette having a first outermost point on said perpendicular axis and a second outermost point on said perpendicular axis at opposite sides of said width;

said connections being disconnectable such that it is possible to detach one cuvette from said at least one row so as to be placed in said stand;

at least one holder member on the outer surface of each cuvette;

said at least one holder member being located at an angle offset from the longitudinal axis of the at least one row of cuvettes and being located substantially between said longitudinal axis and either of said first and second outermost points of said widths of the cuvettes, said at least one holder member on the outer surface of each cuvette being at a location such that (1) when said at least one row of cuvettes is still interconnected, said at least one holder member of each cuvette is at said angle from the longitudinal axis and is substantially away from fixing contact with said stand and such that (2) when one of said cuvettes of said at least one row of cuvettes is detached and placed within one of said holes with said at least one holder member also within said one of said holes, said one detached cuvette can be rotated such that said at least one holder member is in fixing contact with a wall of said stand.

7. The combination according to claim 6, wherein the at least one holder member is at an angle of approximately 45° from the longitudinal axis of the at least one row of cuvettes.

8. The combination according to claim 7, wherein the at least one holder member is an extension extending from the outer surface of each cuvette, the extension has an outer surface which is a plane; and said at least one holder member is rotated into fixing contact with an intermediate wall of said stand which has a generally planar surface which extends generally in the direction of said longitudinal axis of said at least one row of cuvettes.

9. The combination according to claim 6, wherein the at least one holder member is an extension extending from the outer surface of each cuvette.

10. The combination according to claim 8, wherein the extension has an outer surface which is a plane.

11. The combination according to claim 6, wherein there are two holder members which are positioned on opposite sides of each cuvette.

12. A method of fixing a cuvette from a cuvette matrix within a stand, comprising the steps of:

(a) providing a stand having an array of holes for supporting cuvettes;

(b) providing a cuvette matrix, comprising:

a plurality of cuvettes capable of being placed within said stand both when connected together and individually;

connections formed between adjacent cuvettes which interconnect said plurality of cuvettes together in at least one row;

said at least one row extending along a longitudinal axis connecting centers of said cuvettes;

each of said cuvettes in said at least one row of cuvettes having a width, said width extending along an axis which is generally perpendicular to said longitudinal axis and through a center of said cuvette, said cuvette having a first outermost point on said perpendicular axis and a second outermost point on said perpendicular axis at opposite sides of said width;

said connections being disconnectable such that it is possible to detach one cuvette from said at least one row so as to be placed in said stand;

at least one holder member on the outer surface of each cuvette;

said at least one holder member being located at an angle offset from the longitudinal axis of the at least one row of cuvettes and being located substantially between said longitudinal axis and either of said first and second outermost points of said widths of the cuvettes, said at least one holder member on the outer surface of each cuvette being at a location such that (1) when said at least one row of cuvettes is still interconnected, said at least one holder member of each cuvette is at said angle from the longitudinal axis and is substantially away from fixing contact with said stand and such that (2) when one of said cuvettes of said at least one row of cuvettes is detached, said one detached cuvette can be rotated such that said at least one holder member is in fixing contact with a wall of said stand; and (c) selectively performing at least one of i.) detaching one of said cuvettes from said at least one row, placing the cuvette within one of said holes of said stand, and rotating the cuvette within one of said holes of said stand such that the at least one holder member of the cuvette is brought into fixing contact with a wall of said stand, and ii.) placing said at least one row of cuvettes in said stand such that each said at least one holder member on each said cuvette is at said angle from the longitudinal axis and is substantially away from fixing contact with said stand.

13. The method of fixing a cuvette from a cuvette matrix within a stand according to claim 12, wherein in step (b) the at least one holder member is provided at an angle of approximately 45° from the longitudinal axis of the at least one row of cuvettes.

14. The method of fixing a cuvette from a cuvette matrix within a stand according to claim 13, wherein in step (b) the at least one holder member is provided as an extension extending from the outer surface of each cuvette, the extension is provided with an outer surface which is a plane; and wherein in step (c) said at least one holder member is rotated into fixing contact with an intermediate wall of said stand which has a generally planar surface which extends generally in the direction of said longitudinal axis of said at least one row of cuvettes.

15. The method of fixing a cuvette from a cuvette matrix within a stand according to claim 12, wherein in step (b) the at least one holder member is provided as an extension extending from the outer surface of each cuvette.

16. The method of fixing a cuvette from a cuvette matrix within a stand according to claim 15, wherein in step (b) the extension is provided with an outer surface which is a plane.

17. The method of fixing a cuvette from a cuvette matrix within a stand according to claim 12, wherein in step (b) there are provided two holder members positioned on opposite sides of each cuvette.

* * * * *